United States Patent [19]

Landi et al.

[11] 4,422,183

[45] Dec. 27, 1983

[54] PROTECTIVE BODY SHIELD

[76] Inventors: Curtis L. Landi; Susan L. Wilson, both of 257 San Carlos #5, Sausalito, Calif. 94965

[21] Appl. No.: 193,630

[22] Filed: Oct. 3, 1980

Related U.S. Application Data

[63] Continuation-in-part of Ser. No. 47,233, Jun. 11, 1979, abandoned.

[51] Int. Cl.[3] ..... A41D 13/00

[52] U.S. Cl. ..... 2/2

[58] Field of Search ..... 2/2, 2.5, 24, 16, 411; 428/73, 116

[56] References Cited

U.S. PATENT DOCUMENTS

| | | | |
|---|---|---|---|
| 925,851 | 6/1909 | Sullivan | 2/2 |
| 3,168,746 | 2/1965 | Smith | 2/24 |
| 3,377,875 | 8/1967 | Blakewey | 2/2.5 |
| 4,061,812 | 12/1977 | Gilwee, Jr. et al. | 428/73 X |
| 4,213,202 | 7/1980 | Larry | 2/2 |

FOREIGN PATENT DOCUMENTS

| | | | |
|---|---|---|---|
| 2504849 | 11/1975 | Fed. Rep. of Germany | 2/411 |
| 2614892 | 10/1977 | Fed. Rep. of Germany | 2/411 |
| 2703538 | 11/1977 | Fed. Rep. of Germany | 2/2 |

*Primary Examiner*—H. Hampton Hunter

*Attorney, Agent, or Firm*—Manfred M. Warren; Robert B. Chickering; Glen R. Grunewald

[57] ABSTRACT

A protective body shield including a honeycomb core arranged with the axis of each cell perpendicular to the body of the wearer and a layer of resilient foam covering at least that side of the shield in contact with the body to produce a shield that is rigid and shock-absorbing in the direction of anticipated impacts, but flexible and yieldable in other directions so as to not interfere with movement of the wearer's body.

7 Claims, 6 Drawing Figures

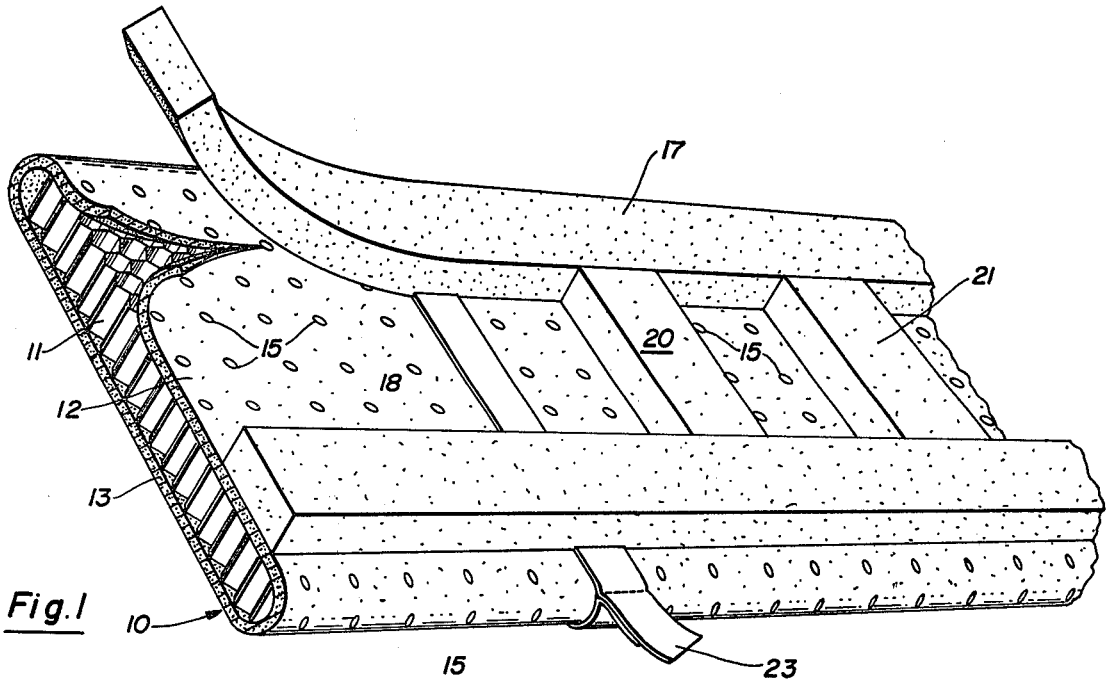
Fig. 1
Fig. 2
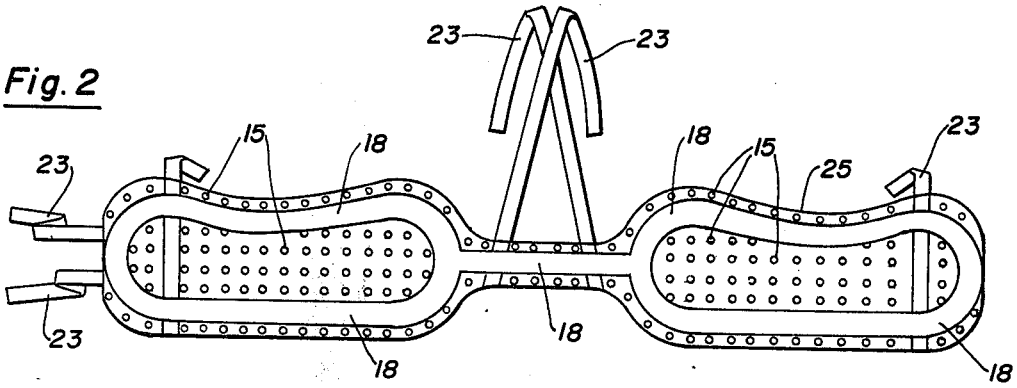
Fig. 3
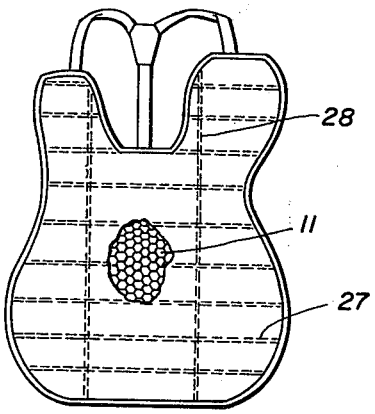
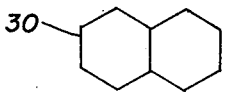
Fig. 4
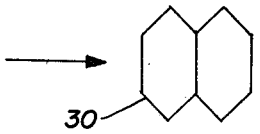
Fig. 5
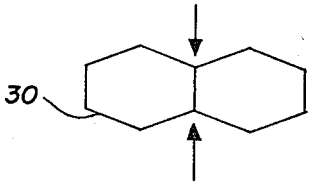
Fig. 6

PROTECTIVE BODY SHIELD

CROSS-REFERENCE TO RELATED APPLICATION

This application is a continuation-in-part of co-pending application Ser. No. 047,233, entitled BODY PROTECTOR filed June 11, 1979, now abandoned.

BACKGROUND OF THE INVENTION

In many applications such as in sports, police work, and in industry it is frequently important to use a protective shield to avoid injury to certain portions of the human body. The head may be protected with a rigid, padded helmet but some areas of the body, for example, the rib cage, must be protected with a flexible material. For example, a football player cannot use a rigid rib cage protector because it would restrict movement and because the rigid protector itself could cause injury if it received an impact from below and were driven, for example, into the player's armpit.

In addition to being flexible, a protective shield is desirably light in weight, previous to air so that the areas beneath it can be ventilated, and not deteriorated by water or persperation. In the past such protective shields have largely been made of foam elastomer. Foam is merely padding which cushions the impact and spreads it over a slightly larger area but it does little to absorb much energy. Foam is very bulky for the amount of protection it affords and it is just as yielding in the direction of absorbing impact as it is in any other direction. Foam absorbs shock equally in all directions and it is equally flexible in all directions. Thus, only a thin, too-flexible and relatively ineffective layer protects against impacts that are perpendicular to the plane of the body, while a wide, too-stiff layer inhibits the movement of the arm and chest of a foam chest protector. Increasing the impact absorbing qualities of a foam body shield necessarily requires making the entire shield thicker, less flexible, more bulky and more difficult to ventilate. Although hard shells placed over foam pads tend to spread impacts over a wider area, as set forth above, the hard shells themselves can cause injuries if the impact is not normal to the thickness of the pad.

SUMMARY OF THE INVENTION

The present invention is a protective body shield that overcomes or greatly mitigates the problems set forth above. The protective body shield of this invention is very light in weight, it is very flexible in the direction perpendicular to impacts and thereby gives great freedom of movement to the person wearing it, the protector is very rigid in the direction of impact, and it is constructed to absorb energy and to distribute the energy of an impact widely throughout the shield. The protective body shield of this invention also can be made significantly thicker without changing its weight and without changing its flexibility in a direction perpendicular to the direction of impact.

The protective shield of this invention includes a core of lightweight, flexible, cellular honeycomb material with the axes of the cells perpendicular to the longest dimension of the protector. Specifically, the cells are always aligned with their walls perpendicular to the body of the wearer. In other words, the body shield of this invention is constructed of many short, honeycomb cells side by side. The term honeycomb in this specification shall mean an array of side by side cells with parallel walls where each cell has its walls in common with the walls of adjoining cells. Most honeycomb materials are made of hexagonal cells but for purposes of this invention the cells may have any shape, such as square or rectangular. The honeycomb material is inherently lightweight because its cell walls are very thin and occupy very small volume compared with the volume of the honeycomb material itself.

The honeycomb material used in the device of this invention is preferably made of nylon-coated paper. One suitable material is an article of commerce made by the DuPont Company and sold under the trademark NOMEX. Force applied to a honeycomb material in the direction parallel to the axes of the cells is resisted by the stiffness of the honeycomb material and such forces are absorbed and widely distributed by the buckling of the side walls of the cells. When one wall of a cell buckles, the other walls of the same cell must also buckle because they are all connected to one another, and since all walls of the cell are also walls of adjacent cells, the walls of adjacent cells also buckle under the effect of a force. This effect gives the honeycomb core of this invention the ability to absorb a great deal of energy from an impact and in addition the energy of impact that is not absorbed is distributed over a wide area beneath the core even though it may be focused on a small area where it occurs.

The device of this invention also includes a resilient layer over both open ends of the cells. The layer is soft, flexible, resilient material, preferably a foam elastomer. The foam elastomer adjacent the body of wearer protects the body from the sharp, rigid cell walls, and the resilient material on the outside of the device of this invention protects another player of a contact sport from injury from the sharp, rigid cell walls. However, the resilient layers perform another, extremely important function, namely, to preserve the cells from destruction while they are absorbing the force of an impact. The thin cells can absorb a great deal of shock by buckling. Although buckling occurs throughout the cell walls, a sharp impact will frequently crush the edges of the cells by deforming them beyond their elastic limit. The resilient layer across the open ends of the cells fills the ends of the cells with resilient material, particularly during an impact, and prevents the edges of the cell walls from crumbling. The resilient material reinforces only the edges of the cell walls and tends to restore them to their original shape when they have been buckled by being subjected to an impact. This effect increases the useful life of a shield made in accordance with the present invention, better distributes the force to be absorbed throughout the cells, and avoids formation of crushed and accordingly thinner portions of the protective shield which would absorb the energy of impact less effectively.

The resilient material is preferably bonded to the ends of the cells but can just be placed there. If the protective shield is to be worn directly, bonding of resilient material to the cell edges is essential, but if the shield is to be placed in an enclosing cover, the various elements can be held in place by their containing cover.

A preferred embodiment of the invention is to bond the resilient material to the edges of the cells. It has been found that adhesive flows around the edges of the cells forming a thickened region that produces a "footprint" instead of a sharp edge. This thickened region provides a larger area for the resilient material to bear against and further provides a structure that resists crushing of the edges of the cell walls.

In another embodiment of the invention a mesh, for example made of nylon that is heat pressed or glued over the ends of some or all of the cell edges. This embodiment of the invention causes the resultant protective shields to absorb greater impacts without significantly increasing the weight of the shield. Shields of this embodiment are stiffer than shields made without a nylon mesh and are useful for thigh pads or shin guards. A particularly suitable mesh for use in this embodiment is a product of the Hexcell Company available under the registered trademark HEXCELLITE. The mesh may be installed over the ends of cells as sheets or as strips that are spaced from each other.

The resilient material need only be thick enough to blunt the sharp edges of the cells because the impact forces are absorbed by the core. Perforations in the resilient material will provide a breathable shield in that the open nature of the core is no impediment to ventilation no matter how thick it is. The body shield of this invention may be provided in appropriate shapes and with appropriate straps as is known to the art. The body shield of this invention may also be provided with additional strips of resilient material mounted on the side against the body to give extra protection to areas that are particularly tender. In a preferred embodiment of the invention the resilient material has a mesh, such as a nylon scrim, bonded to its outer surface. This mesh maintains the dimensional stability of the resilient material, prevents tearing, and increases the life of the body shield.

DETAILED DESCRIPTION OF THE INVENTION

This invention may be best described with reference to the accompanying drawings which illustrate various devices embodying the invention.

FIG. 1 is a perspective view of a protective shield embodying the invention.

FIG. 2 is a plan view of a rib protector embodying the invention.

FIG. 3 is an elevation view of a chest protector embodying the invention.

FIG. 4 illustrates schematically an end view of two cells of the core with no force applied to them.

FIG. 5 illustrates the cells of FIG. 4 as they would appear with force applied to them in the direction of the arrows.

FIG. 6 illustrates the cells of FIG. 5 as they would appear with force applied to them in the direction of the arrows.

Referring to FIG. 1, the protective body shield of this invention is generally designated 10 and it is constituted of a honeycomb core 11 having a resilient flexible material covering the open ends of the cores that are on the body side of the device 12 and a layer of resilient material covering the open ends of the cells on the outside 13. In the particular embodiment shown in FIG. 1 a single piece of resilient foam material is employed which wraps completely around the core, covering not only its inside and outside layers but also the sides. The resilient layer is preferably perforated with openings 15 on both the inside and outside portions to provide ventilation for the wearer in order to dissipate body heat. For purposes of illustration, the edges of the resilient layer 12 are turned up to illustrate the open ends of the cells 11; however, in normal use the resilient material will be bonded with an adhesive material to the open ends of the core cells. The bonding procedure normally results in some adhesive running down a short distance into the core cells which is advantageous in that the continuous collar-like piece of adhesive reinforce the edges of the core cells and blunts them.

The device shown in FIG. 1 also illustrates a preferred embodiment of the invention wherein strips of thick resilient material 17 and 18 run the length of the protective shield to further improve its ability to protect the wearer from impacts. Cross-members 20 and 21 may be employed to shield a particularly sensitive spot, such as a previously injured rib, by being assembled into the shield so that the empty area between them bridges the tender spot of the wearer and prevents any contact with that spot. Normally, the core is rigid enough to prevent deformation into a small area such as the space between elements 20 and 21 so that no contact whatsoever will be made between the shield and the tender portion of the body that is so protected.

The shield may also be provided with one or more straps such as 23 to secure the shield to the body of the person using it. As was mentioned previously, the shield may also be employed by being enclosed within a fabric or other flexible cover, which cover is made with straps for securing the shield to the user.

FIG. 2 illustrates the device of this invention in the specific form of a chest or rib protecting shield. The device is cut with curvature on the top edge 25 to fit beneath the armpit of a person wearing it but to rise above the armpit level across the chest and back of the person wearing it. The interior of the particular chest protector shown is provided with additional pads 18 and with straps for securing it such as at 23. The device also includes perforations 15 for purposes of ventilating and cooling the user.

The device illustrated in FIG. 3 is typical of a chest protector for an umpire or catcher. The cutaway section illustrates cells 11. Preferably the chest protector illustrated in FIG. 3 will have many small cell clusters contained in small pockets whereby there can be both horizontal seams such as 27 and vertical seams such as 28. The device constructed in accordance with FIG. 3 will be extremely flexible in that seams 27 and 28 will act as hinges so that large sections of the chest protector can bend along those hinges while the cells 11 can crush both in a horizontal and vertical direction as will be illustrated subsequently so that the device can assume smaller dimensions in both the horizontal and vertical direction without applying large force or without destroying its ability to restore itself to its original shape or absorb impacts with the same efficiency as when it is not so distorted.

FIG. 4 illustrates schematically two cells from a cluster of cells that would be useful in a device of this invention. In all cases the cells will be in groups having far more cells than two. The cells of FIG. 4 are hexagonal in shape and each wall 30 is the same length as each other wall 30. Cells can have different shapes and are not limited to having six walls. The cells of FIG. 4 share one common wall, but in a cluster all walls would be common with at least one other cell except for some walls of cells on the end. The cells illustrated in FIG. 4 are shown with no forces applied to them in any direction.

FIG. 5 illustrates the cells of FIG. 4 with forces applied in the direction of the arrows. When forces are so applied, the cells distort by becoming tall and narrow. Very small force in the direction of the arrows is required to make such a distortion since each intersection of one wall with another acts as a hinge. A distortion such as is illustrated in FIG. 5 would be typical of a situation where a football player wearing a vest made in accordance with this invention would twist his body as when throwing a football or avoiding a tackler. In the direction of the arrows of FIG. 5, the cells have great flexibility and offer substantially no resistance to distortion.

FIG. 6 illustrates the cells of FIG. 4 with force applied in the direction of the arrows. Again, only a small force in the direction of the arrow is capable of distorting these cells as shown so that the entire protector may become much narrower in the direction of distortion from only a small applied force. A typical situation where such applied forces would occur in use is if a football player were throwing a football, leaning to one side, twisting or bending while making an evasive movement when running. It is again emphasized that such small force is necessary to distort the cellular core in the direction of the arrows in FIG. 6 that such movements would be unhampered by the core.

In all cases in FIGS. 4, 5 and 6, a force applied to the cells perpendicular to the plane of the paper would be strongly resisted by the stiff cell walls in that direction. Although each individual cell wall is thin, its connecting cell wall which is at an angle to the plane of the cell wall in question would have to be distorted longitudinally in order for the thin cell wall to crush or buckle. This "I-beam" effect causes each thin, flexible cell wall to be held rigid by its position with respect to other cell walls in the array.

What is claimed is:

1. A protective shield comprising a core of lightweight, flexible, cellular, honeycomb construction having the axes and walls of the cells thereof perpendicular to the largest plane of said shield, flexible hinges formed by the intersection of one wall with another, and resilient, flexible, foam elastomer covering the open ends of said cells whereby said shield is highly flexible in its largest plane and is less flexible in planes perpendicular to said largest plane.

2. Claim 1 wherein said foam elastomer is perforated for air circulation.

3. Claim 1 wherein strips of resilient padding are mounted on one side of said shield.

4. Claim 1 wherein strips of resilient padding form a closed area on one surface of said shield.

5. Claim 1 wherein said core is nylon-coated paper.

6. Claim 1 wherein said protective shield is contained within a fabric cover.

7. Claim 6 wherein said protective cover includes a plurality of pockets each of which contains a core of lightweight flexible, cellular honeycomb material.

* * * * *